US007328742B2

(12) United States Patent
Slack

(10) Patent No.: US 7,328,742 B2
(45) Date of Patent: Feb. 12, 2008

(54) SEAL CUP FOR A WELLBORE TOOL AND METHOD

(75) Inventor: Maurice William Slack, Edmonton (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 10/537,771

(22) PCT Filed: Dec. 8, 2003

(86) PCT No.: PCT/CA03/01890

§ 371 (c)(1),
(2), (4) Date: Dec. 20, 2005

(87) PCT Pub. No.: WO2004/053289

PCT Pub. Date: Jun. 24, 2004

(65) Prior Publication Data

US 2006/0151182 A1 Jul. 13, 2006

(30) Foreign Application Priority Data

Oct. 9, 2003 (CA) ..... 2444648

(51) Int. Cl.
*E21B 33/12* (2006.01)

(52) U.S. Cl. ..... 166/202; 277/335

(58) Field of Classification Search ..... 166/202; 277/335

See application file for complete search history.

(56) References Cited

U.S. PATENT DOCUMENTS

| | | | | |
|---|---|---|---|---|
| 1,730,804 | A | 10/1929 | Christenson, Jr. | |
| 2,295,770 | A | 9/1942 | Baker | |
| 2,585,706 | A * | 2/1952 | Ware | 166/129 |
| 2,606,618 | A | 8/1952 | Page | |
| 2,630,866 | A | 3/1953 | Ragan | |
| 2,674,315 | A | 4/1954 | Brown | |
| 3,316,971 | A * | 5/1967 | Brown | 166/99 |
| 3,346,267 | A | 10/1967 | Farley | |
| 3,450,412 | A * | 6/1969 | Collett | 277/335 |
| 3,940,938 | A | 3/1976 | Durhan et al. | |
| 4,149,566 | A | 4/1979 | Stowe | |
| 4,586,567 | A | 5/1986 | Jameson | |
| 5,078,211 | A | 1/1992 | Swineford | |

FOREIGN PATENT DOCUMENTS

WO WO 2004/053288 6/2004

* cited by examiner

*Primary Examiner*—Hoang Dang
(74) *Attorney, Agent, or Firm*—Bennett Jones LLP

(57) ABSTRACT

A seal cup and method is disclosed that can be used on a wellbore tool. The seal cup includes an external circumferential seal land adjacent the cup lip and an outer surface capable of permitting drainage away from the seal land of fluids, which may seep past the seal land. This acts against pressure invasion in the interfacial contacting region between the seal cup and the structure, for example, a wellbore liner against which it is sealed.

12 Claims, 6 Drawing Sheets

SEAL CUP FOR A WELLBORE TOOL AND METHOD

FIELD OF THE INVENTION

This invention relates to a seal cup for a wellbore tool and, in particular, a seal cup for sealing and anchoring against a differential pressure in a wellbore and a method for enhancing the resistance of a seal cup to axial sliding when under operational differential pressure.

BACKGROUND OF THE INVENTION

Seal cups, also called cup seals, can be used in wellbore applications to seal against differential pressures in a pipe string. A seal cup includes a base and a tubular wall or skirt extending therefrom. A seal cup can be deployed downhole in a non-sealing configuration, but will tend to expand and promote sealing against the pipe wall in which it is positioned when exposed to a differential pressure and, in particular, a pressure differential with a greater pressure at its tubular wall end.

Furthermore, the differential pressure across the seal cup gives rise to axial load that must be reacted to prevent the seal cup from displacing in the direction of differential pressure. In certain applications where it is desirable to position the seal cup in a fixed position, it is necessary to provide an anchoring mechanism on the tool to work with the cup.

SUMMARY OF THE INVENTION

A seal cup for a wellbore tool has been invented and a method to promote pressure activated anchoring of a seal cup.

In accordance with a broad aspect of the present invention, there is provided a seal cup including: a base, an elongate substantially tubular interval extending from the base and ending at a lip, at least a portion of the tubular interval being capable of radially expanding under application of operational pressure, an outer surface extending from the lip to the base, and at least one circumferential seal land on the outer surface adjacent the lip of the tubular interval; at least a portion of the outer surface being capable, under operational pressure for which the seal cup is to be used, of conducting seepage fluid from adjacent the seal land toward the base to act against pressure invasion about the outer surface.

In accordance with a broad aspect of the present invention, there is provided a seal cup for mounting on a wellbore tool to seal the annulus about the tool when used in a wellbore defined by a wellbore wall, the seal cup including: a base including a portion mountable to the tool, an elongate substantially tubular interval extending from the base and ending at a lip, an outer surface extending from the lip to the base, and at least one circumferential seal land on the outer surface adjacent the lip of the tubular interval, the seal land including a diameter selected to allow sealing in the annulus about the tool in the wellbore in which the seal cup and tool are to be used; at least a portion of the tubular interval being capable of radially expanding under application of operational wellbore pressure to drive a portion of the outer surface into frictional contact with the wellbore wall and at least a portion of the outer surface being capable, under wellbore pressure, of conducting seepage fluid from adjacent the seal land toward the base to act against pressure invasion about the outer surface in the portion of contact.

In accordance with another aspect of the present invention, there is provided a method for enhancing resistance to axial sliding of a seal cup in a tubular member under application of operational differential pressure, the method including: providing a seal cup including a base, a cup skirt extending from the base and a skirt lip; forming the cup skirt such that a sealing barrier can form adjacent the skirt lip; selecting the cup skirt to expand radially under the operational differential pressure to create an interfacial region of contact of the cup skirt against the tubular member between the sealing barrier and the base; selecting the cup skirt to provide for drainage of fluid from the interfacial region of contact away from the seal barrier, which fluid seeps past the sealing barrier under the operational differential pressure.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE INVENTION

Figure 1:
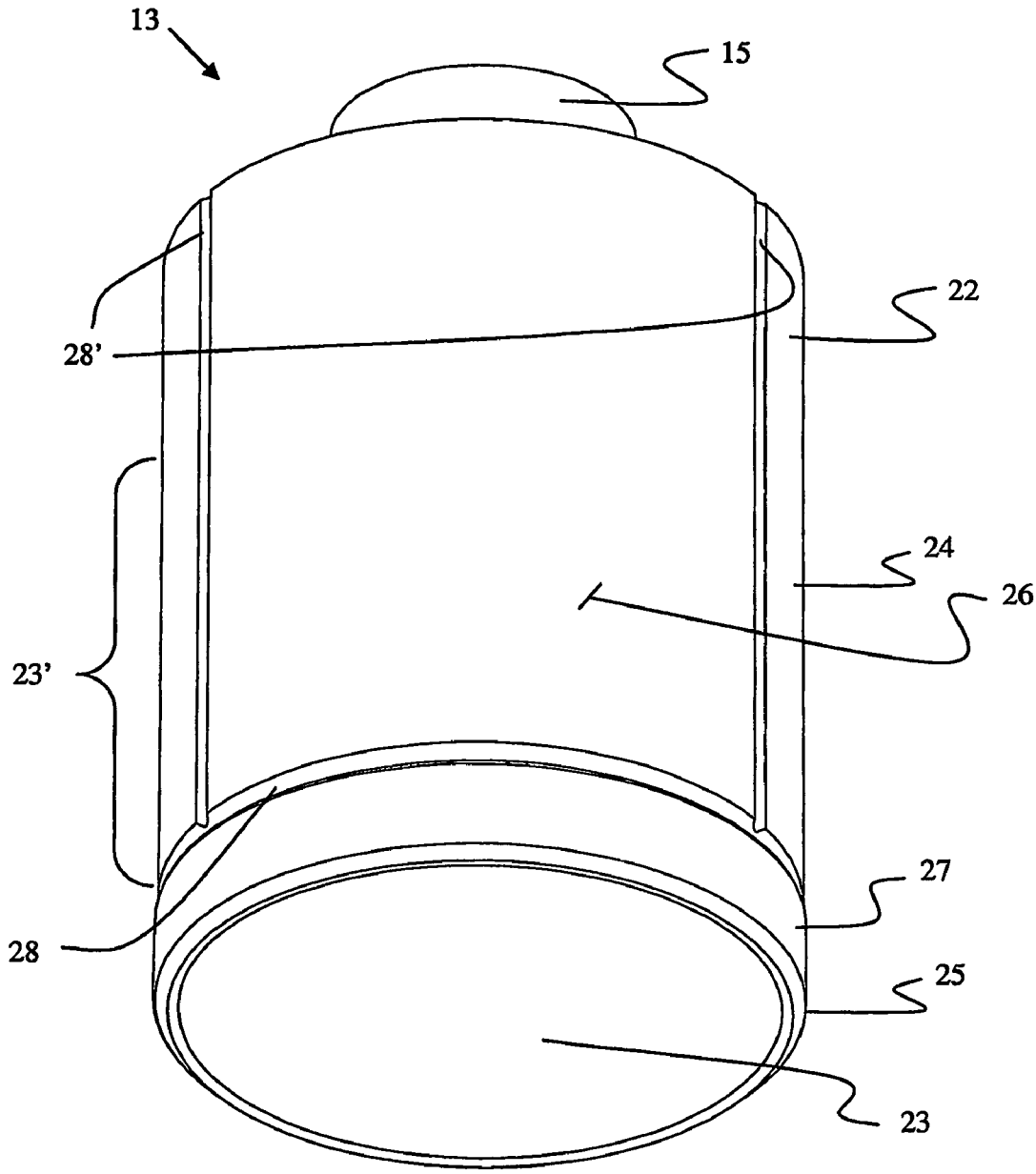
FIG. 1 is a perspective view of a seal cup.

A seal cup for a wellbore tool and method are described herein.

The seal cup can be used for running downhole to create a seal when exposed to a pressure differential. The seal cup can be mounted on a tool to create a seal in the annulus between the tool and the borehole wall or wellbore liner in which the tool is positioned. Since the seal cup will most often be used in a wellbore liner, such as casing, the description will proceed with reference to casing. When in a sealing configuration, the seal cup can exhibit a pressure activated anchoring effect to act against undesirable axial movement along the wellbore, as may be caused by the pressure differential or other applied forces.

The seal cup can include a base, an elongate substantially tubular interval extending from the base, which ends at an outboard lip, an outer surface extending from the lip to the base, and at least one circumferential seal land on the outer surface adjacent the lip of the tubular interval. The outer surface of the tubular interval can be capable, under operational pressure under which it is to be used, of conducting seepage fluid from adjacent the seal land toward the base to act against pressure invasion about the outer surface.

The base can include a mounting portion for mounting to the tool. It will be appreciated that there are many ways to attach a seal cup to a tool. In an embodiment wherein the seal cup is to be used on a tool having a bore therethrough for controlled passage therethrough, the seal cup base can include a bore through its base.

The elongate generally tubular interval extends from the base. It usually can be formed integral with the material of the base but could be connected in other ways, for example by polymeric welding, etc., to the base.

The seal cup further includes, as will be appreciated, an outer surface. When the seal cup is positioned in a casing string, its outer surface will face the casing inner surface. At least one circumferential external seal land is provided on the outer surface adjacent the outer lip of the tubular interval. The diameter of the seal land can be selected to allow sealing engagement with the casing inner diameter in which it is to be used and therefore in its unconstrained expanded position will generally be of a diameter greater than the casing inner diameter.

At least a portion of the tubular interval can be capable of radially expanding under application of operational wellbore pressure to drive a portion of the outer surface into frictional contact with the wellbore wall in which the seal is positioned.

The portion of the outer surface that is driven into frictional contact with the wellbore wall can include, as by coating with, supporting or forming with materials selected to increase the friction coefficient between the outer surface and the borehole wall. Such materials can include, for example, grit, metal particles, carbide particles, ceramic particles, etc.

At least a portion of the seal cup outer surface can permit fluid drainage from adjacent the seal land toward the base to act against pressure invasion. Such fluid may arise, for example, due to seepage past the seal land. If such fluid pressure is not relieved from the interfacial region between the seal cup and the casing inner surface, it can reduce the engagement of the seal cup against the casing. In one embodiment, the outer surface along the tubular interval between the seal land and the base can be capable of conducting seepage fluid by for example including passages along or through the material of the outer surface through which fluid can drain from the region in which the outer surface contacts the casing. In another embodiment, a greater portion of the outer surface approaching or extending to the end of the base, can be formed to permit such drainage. As will be appreciated the outer surface formation capable of conducting seepage fluid need only be at that portion of the outer surface which will be in contact with the casing wall when in sealing configuration. However, the entire outer surface can be capable of conducting seepage fluid, if desired or convenient.

The portion of the outer surface that permits seepage, can, for example, be roughened, undulating, knobby, scored, formed with seepage grooves, or formed of porous material such that passages are formed for evacuation of fluids out of the region of contact.

The outer diameter of the seal cup along the tubular interval can taper from the seal land to the base. The wall thickness of the tubular interval can generally increase from the lip to the base. The base can have a diameter less than or substantially matching the drift or minimum running diameter of the casing in which it is to be used. These geometries can facilitate radial expansion of the tubular interval to have a relatively large contact region between the cup and the casing and can enhance contact stress between the cup and the casing by creating a steep pressure gradient at the land, when a differential pressure is exerted across the cup.

The seal cup material, as will be appreciated, is selected to be more compliant than the casing material, for example steel, in which it is to be used. The seal cup materials can also be selected with consideration as to the pressure loads under which the seal cup must operate to seal. Of course, the material attributes, such as for expansion and compliancy, can also be considered for thermal response and wellbore conditions to achieve a sealing action. The seal cup material can be, for example, rubber, structural plastic, etc. As will be appreciated, structural plastic, such as polyurethane or glass reinforced polyurethane may be useful to accommodate some downhole pressure loads that are too great for some elastomers such as rubber.

In operation the seal cup, in one embodiment, can exhibit a pressure activated anchoring effect under application of bottom differential pressure. The axial load generated by the pressure differential can be reacted by frictional sliding resistance between the seal cup tubular interval and the confining casing wall. This pressure activated anchoring effect can be permitted by providing at least a portion of the outer cup surface between the seal land and the base, to be capable, under operational pressures, of conducting seepage fluid from adjacent the seal land toward the base and out from the interfacial region of contact between the seal cup outer surface and the confining casing wall. The pressure activated anchoring effect can also be enhanced by forming the seal land adjacent the outer lip and forming the seal cup, at least along a length of the tubular interval, to have a outer diameter selected to contact the casing wall, when under pressure load.

In operation, the compliance of the selected seal cup material allows the tubular interval to expand readily under application of modest pressure until it contacts the much lower compliance confining casing wall. Application of additional pressure can serve to directly increase the interfacial contact stress and proportionately the axial force required to induce frictional sliding between the seal cup tubular interval and the casing wall. Axial load arising from differential pressure acting across the base may, thus, be reacted in part by tension where it is joined to the tubular interval.

It will be appreciated that, when mounted on a downhole tool including an anchoring system for anchoring along the wellbore, the pressure activated anchoring effect of the seal cup can reduce the load capacity required from the tool's anchoring system and thus, can enhance the overall anchoring properties of the tool. For example, use of the pressure activated anchoring effect of the seal cup can reduce the axial pressure end load that needs to be reacted through the tool's anchoring system. This seal cup can provide a substantial improvement in the ability to use lower strength, readily drillable materials in the anchoring mechanisms and bodies of downhole tools.

Figure 2:
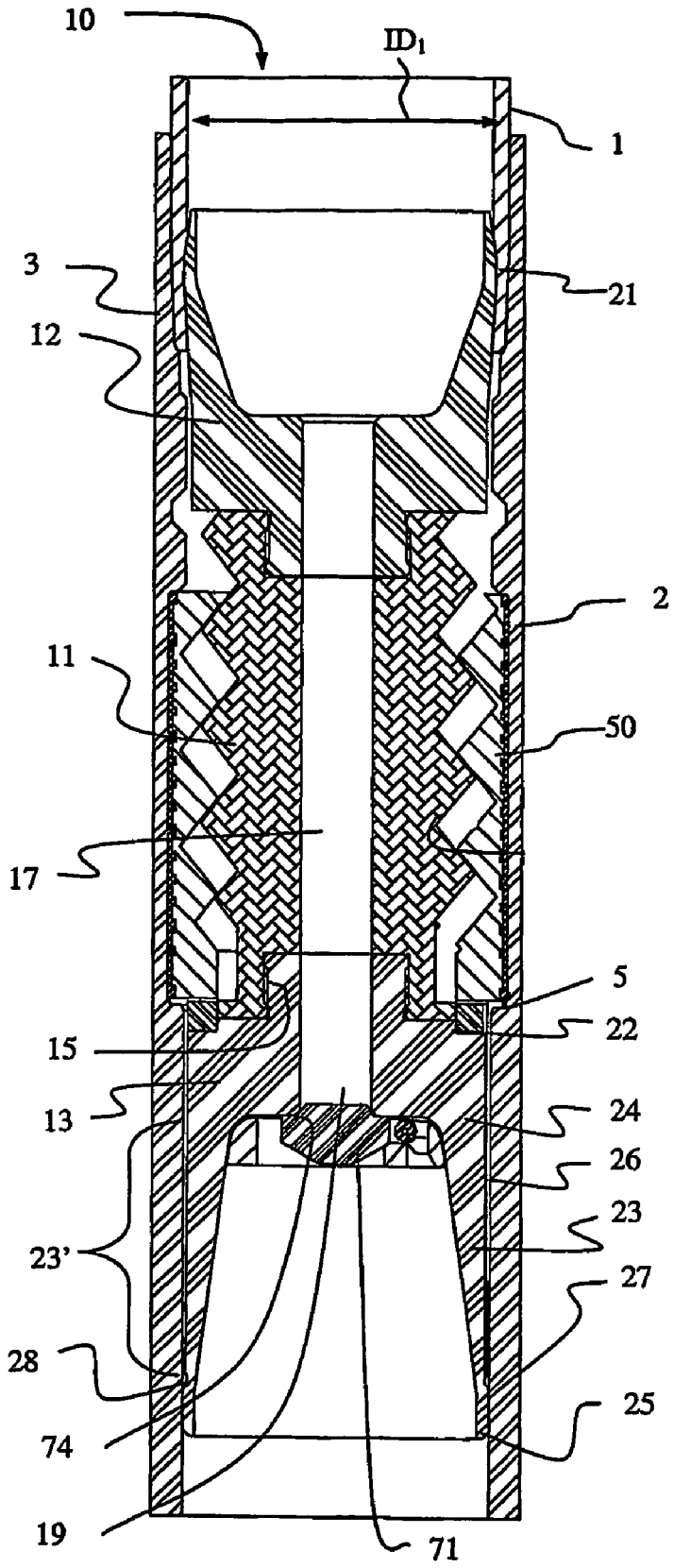
FIG. 2 is a vertical section through a portion of well casing including a wellbore tool with a seal cup as in FIG. 1.

FIG. 1 shows a seal cup 13. FIG. 2 shows the seal cup of FIG. 1 installed on a wellbore tool 10, the tool and the seal cup being positioned in a string of casing 1 including a profile nipple 3.

Seal cup 13 in the illustrated embodiment can include a base 22 with a diameter selected to pass through the casing inner diameter ID1 in which it is to be used and a tubular wall interval 23 extending from the base and including an outer end lip 25. Outer end 25 is open such that the base and the tubular wall form a cup. The seal cup can include at least one external circumferential seal land 27, the diameter at the seal land being selected to allow substantial sealing engagement with the casing inner diameter ID1 in which it is to be used. The seal cup includes an outer surface 26 permitting seepage of fluid from adjacent the seal land past the base to act against pressure invasion about the external surface.

Seal cup 13 can be shaped as by molding, polymeric welding or machining to form base 22 integral with elongate seal tube 23. The seal tube can include an end 24 adjacent base 22 and opposite open end 25. The external surface 26 of seal cup 13 defines circumferential external seal land 27 adjacent end 25. In the illustrated embodiment, the seal cup diameter at base 22 is substantially similar to the drift or minimum running diameter of the casing. The seal cup diameter along the tubular interval, indicated generally at 23' and extending from seal land 27 to the seal tube end 24, can be generally tapered to blend with the base 22. The tubular wall of seal tube 23 can have a thickness that substantially increases from the outer end 25 to the base. This wall thickness can correlatively increase the axial load-accommodating capacity with increased distance from the seal land. The thinner wall area, being at outer end 25, decreases radial stiffness at that end to, thereby, reduce contact stress and wear while running in and promotes higher radial contact stress from the pressure energization effect while sealing and anchoring.

External surface 26 can be provided with a circumferential seepage groove 28 adjacent seal land 27 on its sealed side (closest to base 22) and one or more seepage grooves 28' extending from groove 28 toward the base, which grooves 28, 28' are sized to permit passage therethrough, and drainage, of well bore fluids that might seep past seal land 27 when acting to seal against borehole pressure. As such, fluid seeping past the seal land can be drained from the interfacial contacting region adjacent the seal land to increase the portion of the radial compressive stress in the interfacial region. This can increase friction between the seal cup and the casing against which it is intended to seal.

While seepage grooves are shown in FIGS. 1 and 2, it is to be understood that other surface treatments, materials or forming can be used to permit seepage of fluids away from the seal land. For example, the outer surface can, for example, be roughened, scored, knobby, formed with seepage grooves, or formed of porous material. Any surface treatments, materials or forming should be selected with consideration as to the fluids which are likely to seep past the seal land in order that the passageways through or along the surface, as formed by the pores of the porous material or by surface forming (i.e. scoring, roughening, etc.) are capable of permitting seepage of that fluid.

While the outer surface in the illustrated embodiment includes seepage grooves extending along its full length between seal land 27 and the end of the base, the outer surface need only be capable of seepage in the interfacial area where close contact occurs between the outer surface and the casing.

In the illustrated embodiment, end 25 is inwardly radiused adjacent seal land 27 to facilitate its riding over discontinuities, such as threaded connections, in the casing inner surface, for example during run in.

Seal cups can be formed in various ways and from various materials, as will be appreciated. The seal cup material can be selected to be more compliant than that casing material (generally steel) against which the cup material is to seal. The seal cup material can also be selected with consideration as to the pressure loads in which it must seal. Of course, the material used can also be considered for borehole conditions such as thermal expansion and compliancy and resistance to corrosive fluids. In one embodiment, the seal cup can be formed from a compliant (relative to casing material) and drillable material, such as polyurethane or fiber-reinforced polyurethane, and can have a surface including wear resistant and/or friction coefficient enhancing materials.

Seal cup 13 includes a mounting portion 15 for mounting the seal cup to tool 10. While various mounting mechanism can be used, in the illustrated embodiment mounting between the seal cup and the tool is by way of threads providing a substantially sealed interface. A threaded connection was used in the illustrated embodiment to facilitate manufacture and assembly and to allow options in selection of materials.

Tool 10 in the illustrated embodiment is a cement float. However, it is to be understood that the seal cup can be used with other kinds of tools such as plugs, etc. Since the tool includes a bore 17, seal cup 13 also has a bore 19 therethrough. Since a check valve is required for a cement float, the valve has been, but need not be, mounted on seal cup 13. In the illustrated embodiment, therefore, seal cup carries a valve 71 and defines a seat 74. In the illustrated embodiment seal cup 13 opens downwardly relative to the tool and thereby acts to seal against fluid pressures from below the tool when valve 71 seats against 74 to seal the opening of bore 17.

Cement float tool 10 includes an anchoring mechanism generally shown as 50. The tool can be configured to pass through casing 1 and to latch, by way of anchoring mechanism 50, into an annular groove 2 in profile nipple 3. The diameter $D_2$ in groove 2 is slightly larger than the minimum inner diameter of the casing tubing. FIG. 2 shows the cement float tool 10 secured in the casing in the annular groove of a profile nipple. While particular embodiments of a tool and an anchoring mechanism are shown, it is to be understood that the seal cup can be used with other tools with or without anchoring mechanisms.

Cement float 10 includes a mandrel 11 to which is connected a top seal cup 12 and seal cup 13 at its lower end. The cement float is sized to pass through $ID_1$, of the size of casing in which it is intended to be used, with seal cups 12, 13 sealing against the $ID_1$. Top seal cup 12 can include an elongate upper tubular interval, configured with at least one external upper seal land 21 and selected to adequately seal between the casing and main body against top pressure required to pump the cement float tool down the casing until latched in the profile nipple 3 and any subsequent top pressuring as may be required to, for example, fail a shear plug as described hereinafter.

As was described hereinbefore, seal cup 13 is configured to create a seal about the annulus of the tool and can assist with anchoring of the tool.

In operation, a tool as shown in FIG. 2 can be run into a casing string and seal cup 13 can be used to seal the annulus between the tool and the casing inner diameter. In its operation, tool 10, which is a cement float, is placed inside casing 1 and displaced downhole by pumping fluid, typically drilling fluid, through the casing string. Top seal cup 12 and a plug (not shown) in bore 17 tend to prevent flow of the pumping fluid past the cement float tool creating a downward axial force as a function of the applied top differential pressure required to overcome drag where the top seal cup 12, bottom seal cup 13 and anchoring mechanism 50 contact the casing.

Once the cement float tool has been displaced downward to the point where the anchor mechanism is latched into the groove 2 (FIG. 2), application of top pressure produces a downward acting axial load that is transmitted through the main body 11 to the anchoring mechanism, a part of which is pressed outwardly into groove 2. Continued axial force on the tool, once it is in the groove, is reacted into the casing at lower shoulder 5. It will be apparent that the interacting mandrel and anchor carriage functions as an anchor so that pressure load sealed across top seal cup 12 is reacted by the anchoring mechanism into the casing allowing the bore plug to be blown out.

Following placement of the tool, cement can be introduced to the casing string and be displaced into the casing annulus through tool 10 (FIG. 2). Flapper valve 70 functions as a check valve during flow of fluids as required for cementing. If casing string conditions permit, there can be a tendency for the heavier cement column in the annulus to 'U-tube' from the annulus back into the casing. This flow is prevented by the flapper valve 70 with consequent increase of differential bottom pressure across bottom seal cup 13. Initial bottom pressure load across the bottom seal cup 13 tends to make it inflate, seal and can cause it to slide uphole; but this sliding can be limited by the interaction of anchoring mechanism 50 engaging in groove 2 and by the pressure activated anchoring of seal cup 13.

This pressure activated anchoring mechanism is induced under application of differential pressure from below due to the seepage grooves 28 and 28' which relieve fluid pressure, by permitting drainage thereof, in the interfacial contact region between the seal cup and the casing. In addition, the seal land 27 is positioned adjacent end 25 of the seal tube 23 so that the full pressure differential occurs across the wall of seal tube 23 under application of sufficient pressure, driving it to radially expand, contact and become restrained against the liner wall, which in the illustrated case is a part of the profile nipple. Application of additional pressure serves to increase the interfacial contact stress, which contact stress gives rise to frictional resistance to axial sliding of the seal tube 23. The further combination of selecting the lower cup material to be more compliant than the casing and ensuring minimum clearance is maintained between the seal tube and inner diameter ID1, promotes contact at lower differential pressure and thus greater resistance to sliding for a given differential pressure. The wall thickness and length of seal tube 23 can be arranged to promote pressure activated anchoring under application of differential pressure where the wall thickness of seal tube 23 is generally formed to thicken from its end 25 to its end 24. Its length can be selected to be long enough to ensure all or a significant amount of the differential pressure end load for the intended application is thus reacted by this pressure activated anchoring mechanism. The bottom seal cup can, therefore, function both to seal against bottom pressure and to react the associated end load to assist with anchoring of the tool to which it is attached.

The method for enhancing resistance to axial sliding of a seal cup in a tubular member, such as for example casing, under application of an operational differential pressure acting in a direction tending to induce flow toward the open cup can include: providing a seal cup including a base, a cup skirt extending from the base and a skirt lip; forming the cup skirt such that in operation a sealing barrier forms adjacent the skirt lip; selecting the cup skirt to expand radially under the operational differential pressure to create an interfacial region of contact of the cup skirt against the tubular member between the sealing barrier and the base; and selecting the cup skirt to provide for drainage of fluid from the interfacial region of contact away from the seal barrier, which fluid may bypass the seal barrier under the operational differential pressure. The cup skirt in the region of contact can be selected to include materials enhancing the frictional coefficient between the cup skirt and the tubular member. The region of contact can be selected to have a frictional coefficient sufficient to resist axial sliding under operational differential pressure. The step of providing for drainage of fluid can include forming passages for evacuation of fluid away from the seal barrier. The passages can be formed on the external surface of the cup skirt, as by forming grooves, striations, scoring, a knobby or undulating surface. Alternately or in addition, the passages can be formed by selection of material properties such that porous passages are formed through the skirt. The drainage can alleviate or prevent a differential pressure build up in the interfacial region.

Figure 3:
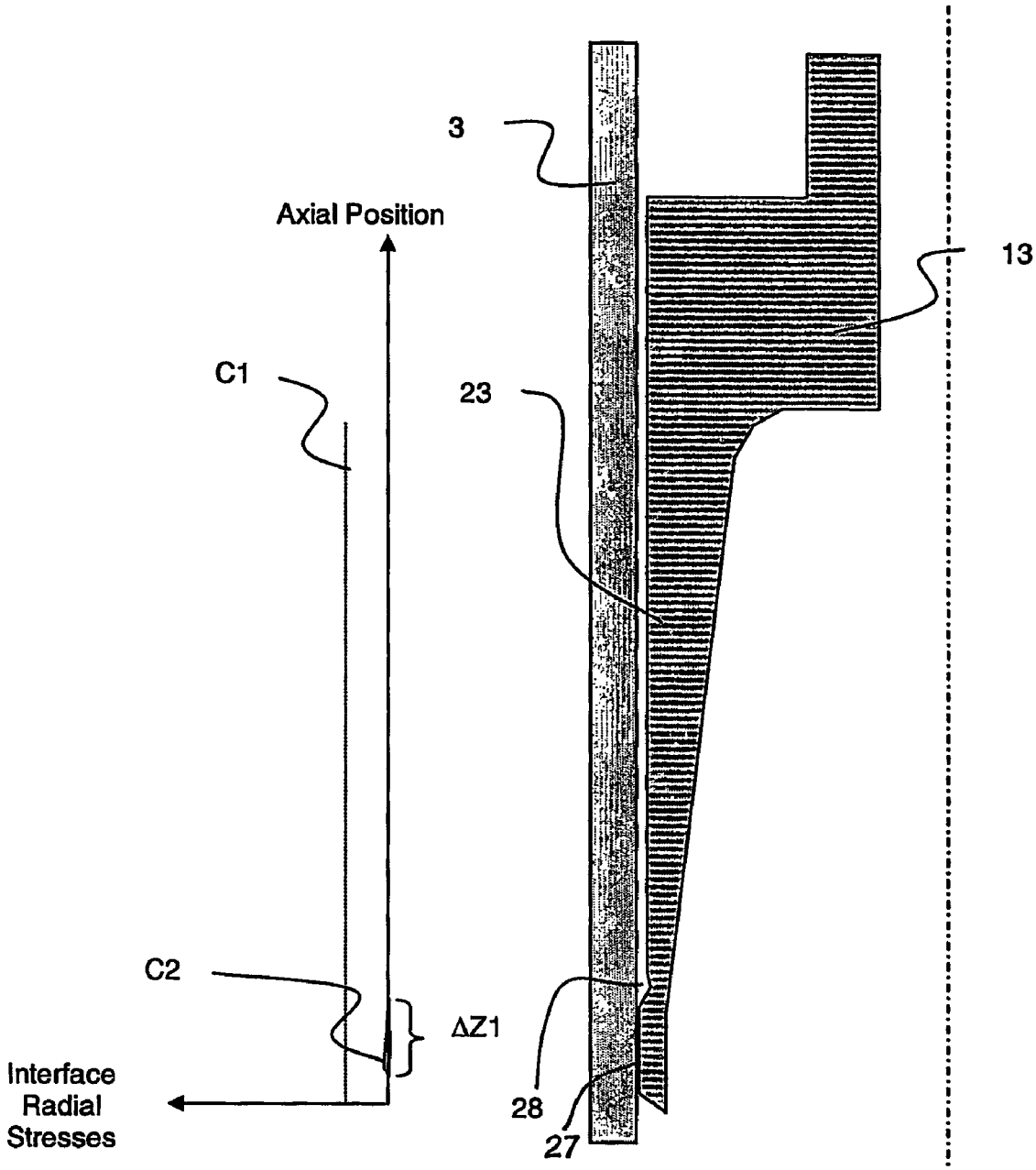
FIG. 3 is an illustrative cross section through a seal cup wall in a wellbore as it would appear in the absence of a pressure differential.

The method of pressure activated anchoring operative when seal cup 13 is sealing against differential pressure is further illustrated with reference to FIGS. 3, 4 and 5 indicating the nature of the contact in the interfacial region between the seal cup and wellbore and hence the manner in which radial and axial loads may be reacted. Referring now to FIG. 3, seal cup 13 is shown as it would appear in the absence of differential pressure. Seal cup 13, in the illustrated embodiment, includes a seal land 27 with a diameter selected to be equal to the wellbore diameter at the location where sealing is desired. Without differential pressure, tubular wall interval 23 is not expanded and does not contact the wellbore. Therefore the only radial stress in the interface is the ambient pressure as indicated by curve C1 in the graph shown opposite the seal cup cross section plotting radial stress as a function of axial position along the tubular wall interval 23. The contact or effective stress in the interfacial region, shown by curve C2, is negligible.

Figure 4:
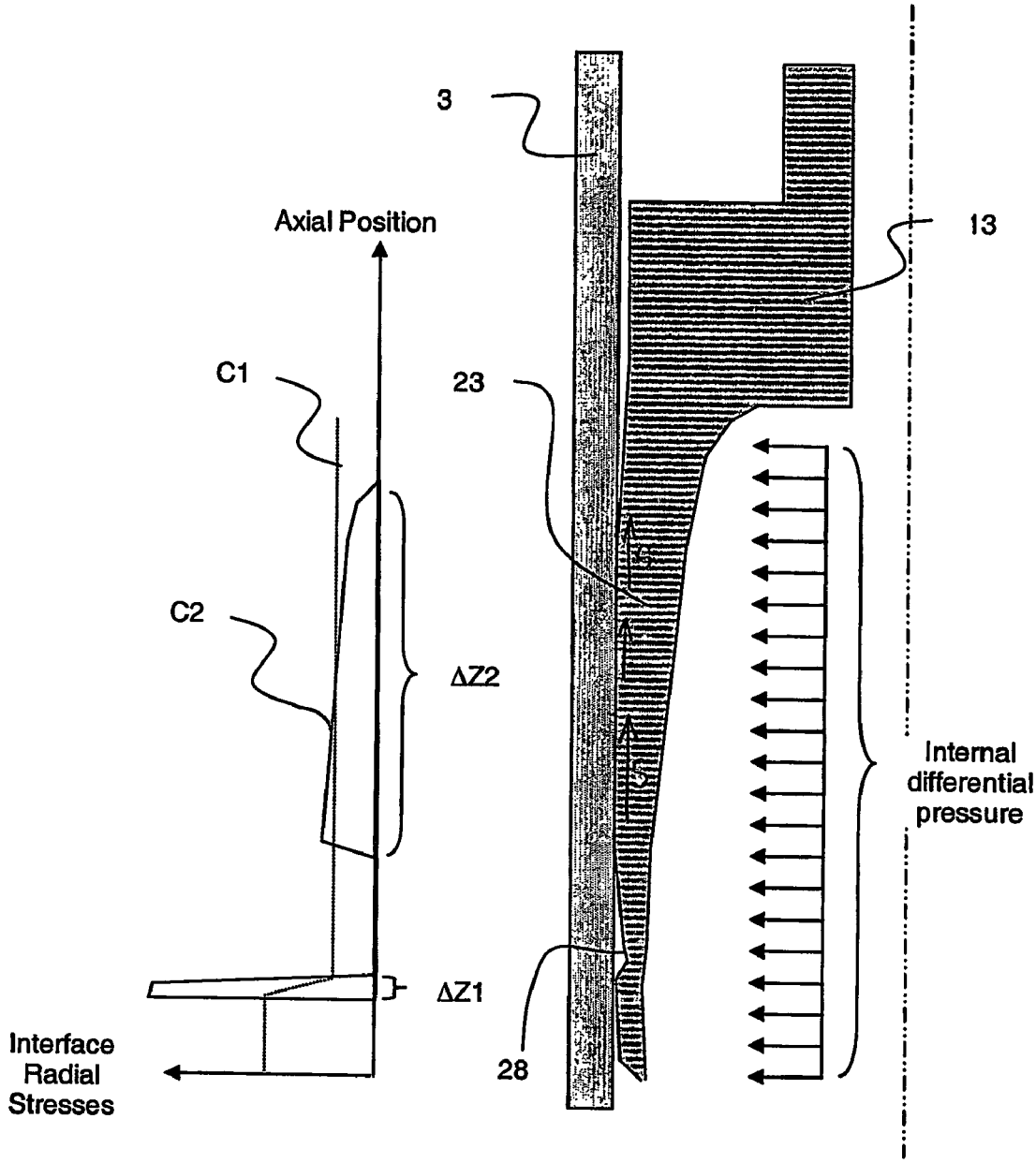
FIG. 4 is an illustrative cross section through the wall of a seal cup in a wellbore configured with seepage grooves as it would appear in the presence of a pressure differential showing the distribution of radial stresses in the interfacial region between the seal cup and borehole.

By reference to FIG. 4 consider next the interfacial radial stress state existing when sufficient internal differential pressure is applied to a seal cup to expand the tubular wall interval 23. Seal cup 13 includes seepage passages, for example including groove 28, for drainage of fluid in a direction along arrows S. As curve C2 shows, in the graph corresponding to this configuration and load case, significant contact stress is developed over the intervals labelled $\Delta Z1$ and $\Delta Z2$. Interval $\Delta Z1$ corresponds to the location where the seal land is forced into contact with the wellbore resulting in contact stress that tends to strongly exceed the pressure to be contained. This condition advantageously promotes sealing at the corresponding axial position and thus the fluid pressure curve C1 is seen to decrease across this same interval by an amount corresponding to the applied differential pressure. This result is assured against incidental seepage by the presence of the seepage passages, which conduct any such seepage flow out of the region of contact. The full pressure differential is thus present across the seal tube wall tending to drive it into contact with the well bore resulting in the large interval of contact $\Delta Z2$. It will be appreciated that the axial load required to move or slide a seal cup thus configured and pressured, is a product of the contact stress, the contact area and the friction coefficient operative in the region of contact area. Thus the anchoring capacity of the seal cup may, in general, be considered as proportional to the area under the curve C2.

Figure 5:
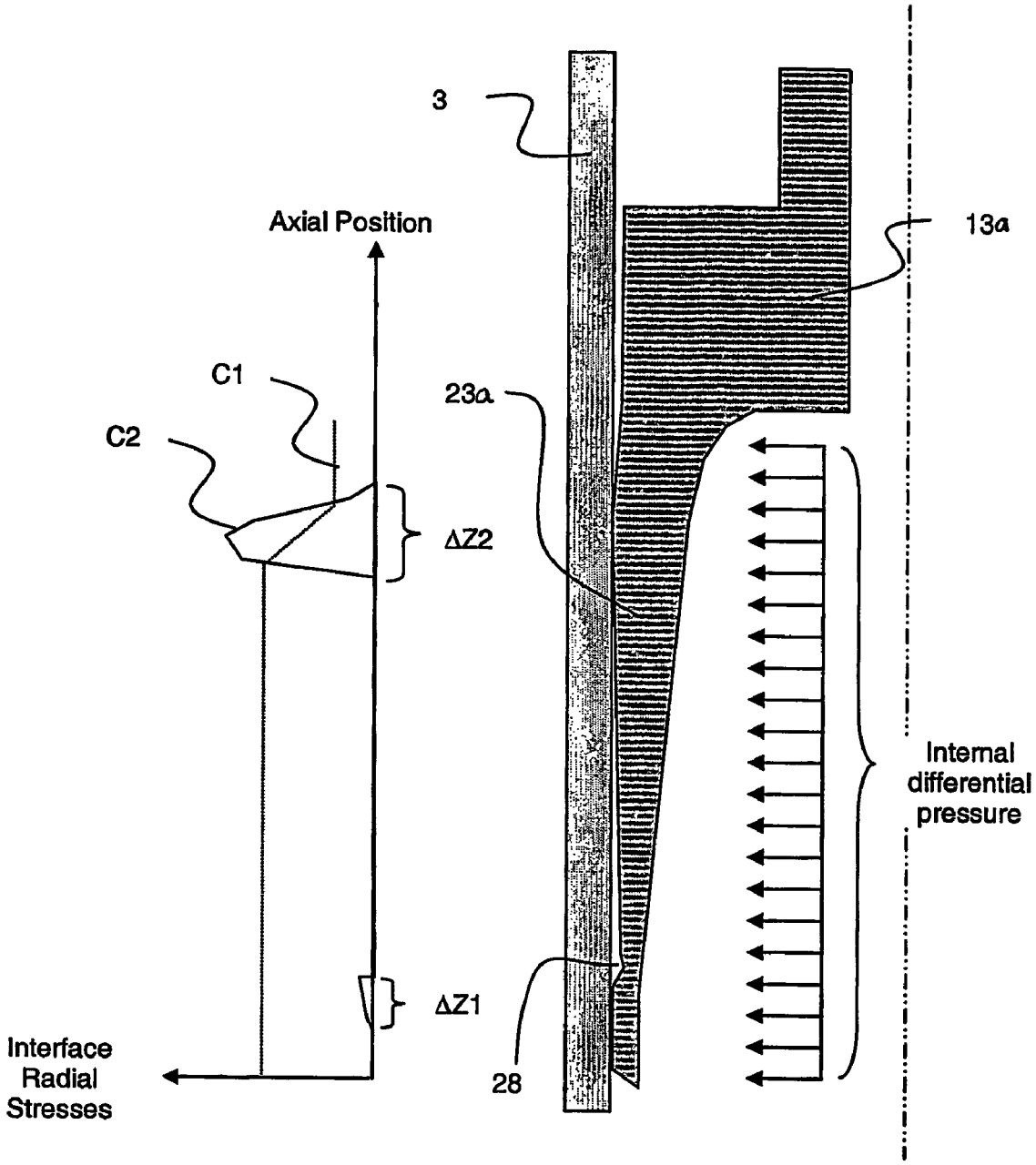
FIG. 5 is an illustrative cross section through the wall of a seal cup in a wellbore configured as it would appear in the presence of a pressure differential showing the distribution of radial stresses in the interfacial region between the seal cup and borehole.

This method of pressure activated anchoring provided by the present invention can be even more fully appreciated by comparing the contact stress state that would tend to develop if a seal cup 13*a* is used without seepage passages from groove 28, which configuration is now considered by reference to FIG. 5. The same differential pressure load is again assumed as in FIG. 4 and the radial stress state in the interfacial region is shown. In this case, seepage flow is allowed to invade far down the seal cup tubular wall interval 23, greatly reducing the area under curve C2 and hence the axial load required to induce sliding, effectively negating most of the pressure activated anchoring function.

The use of a seal cup 13 can, therefore, permit the use of weaker materials, such as drillable materials, for anchoring mechanism 50 and mandrel 11 of a tool to be anchored.

Figure 6:
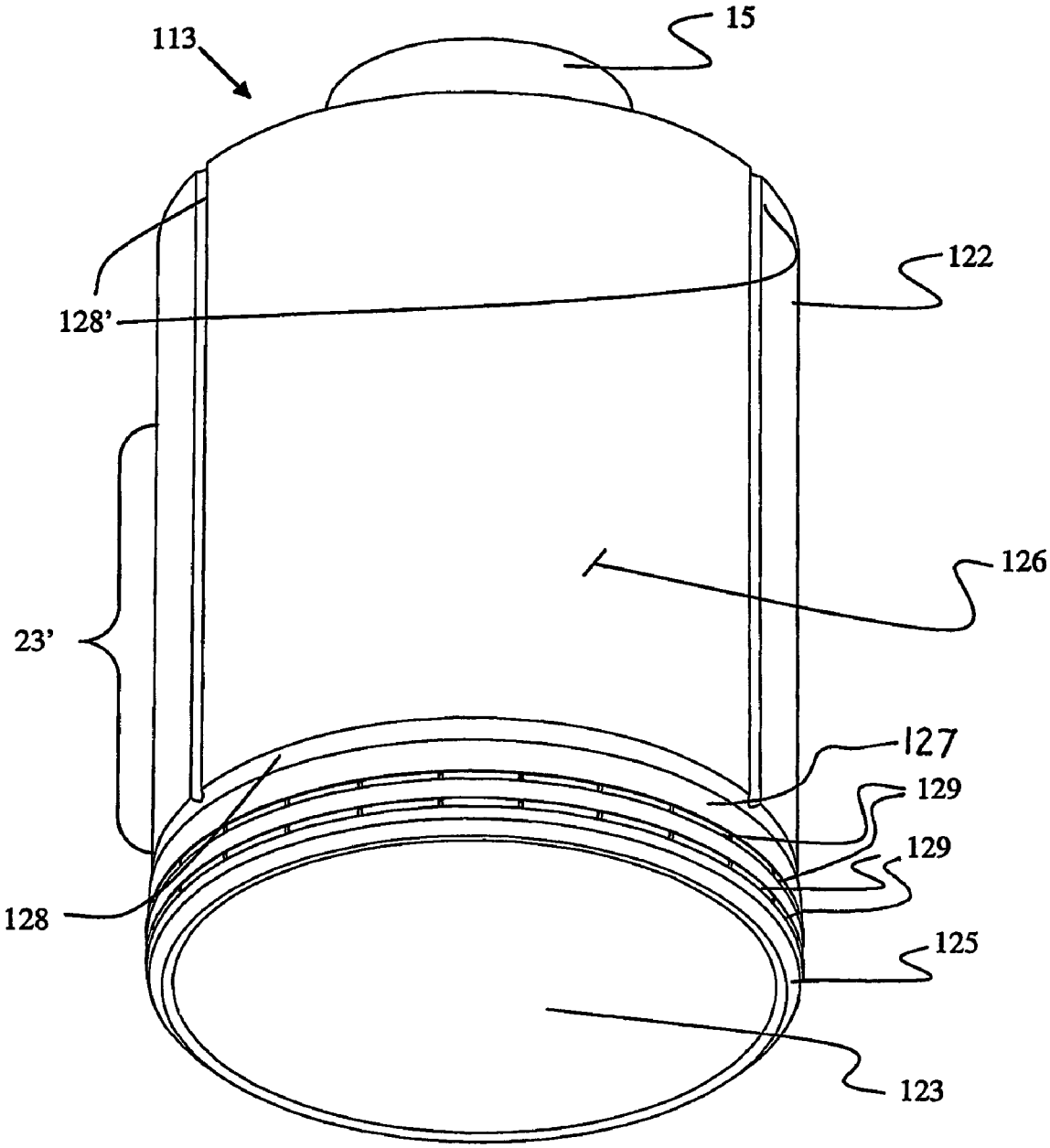
FIG. 6 is a perspective view of another seal cup.

Another seal cup 113 is shown in FIG. 6. Seal cup 113 includes a base 122 with a diameter selected to pass through the casing inner diameter in which it is to be used, a tubular wall interval 123 extending from the base and including an outer end lip 125 and a raised external circumferential seal land 127 on the outer surface 126. The seal cup outer surface includes seepage grooves 128, 128' permitting drainage of fluid away from the seal land to act against pressure invasion, and thereby reduction of friction, about the outer surface.

Outer surface 126 can include wear resistant inserts 129 in the form of an annular hardened steel wire, rods or buttons mounted in glands, as by dovetailing engagement, in the seal region adjacent to or on the seal land.

The diameter at the seal land can be selected to allow substantial sealing engagement with the casing inner diameter, for example, ID1 in FIG. 2, in which it is to be used and can therefore be greater than the casing inner diameter, even when unenergized. Thus, the inserts can be used to protect the seal land of the cup from excess wear, resulting for example from running in, that may deleteriously affect the seal performance of the seal cup.

The inserts can be spaced and configured to provide spaced or substantially uniform circumferential coverage, but to allow sufficient end clearance to permit radial compliance to pass over diameter reductions along the casing, as at threaded connections, and sealing expansion as is required in the sealing region. In the illustrated embodiment, the inserts are spaced apart and clearance is provided between their ends to accommodate radial compression/expansion of the seal cup.

While inserts of annular steel wire have been shown, other wear resistant inserts or surface coatings can be used as desired. While two rows of inserts have been shown positioned on either side of seal land, other numbers (i.e. one or more) and positions can be used.

It will be apparent that many other changes may be made to the illustrative embodiments, while falling within the scope of the invention and it is intended that all such changes be covered by the claims appended hereto.

The invention claimed is:

1. A seal cup comprising: a base; an elongate substantially tubular interval extending from the base and ending at a lip; an outer surface extending from the lip to the base; at least one circumferential seal land on the outer surface adjacent the lip of the tubular interval; a circumferential drainage groove on the outer surface adjacent the seal land; and an axial drainage groove extending from the drainage groove toward the base, the circumferential drainage groove and the axial drainage groove being capable, under operational pressure for which the seal cup is to be used, of conducting seepage fluid from adjacent the seal land toward the base to act against pressure invasion about the outer surface.

2. The seal cup of claim 1 wherein the elongate substantially tubular interval has a thickness increasing from the lip to the base.

3. The seal cup of claim 1 wherein the seal cup has an outer diameter along the tubular interval which tapers from the seal land towards the base.

4. The seal cup of claim 1 wherein the seal cup has an outer diameter along the tubular interval and the base, which tapers from the seal land to the base and the diameter at the base is substantially equal to the inner diameter against which the seal cup is to seal.

5. The seal cup of claim 1 including a radiused portion between the lip and the seal land.

6. The seal cup of claim 1 including a wear resistant insert in the outer surface adjacent the seal land.

7. A seal cup for mounting on a wellbore tool to seal the annulus about the tool when used in a wellbore, the seal cup comprising: a base including a portion mountable to the tool; an elongate substantially tubular interval extending from the base and ending at a lip; an outer surface extending from the lip to the base; at least one circumferential seal land on the outer surface adjacent the lip of the tubular interval, the seal land including a diameter selected to allow sealing in the annulus about the tool in the wellbore in which the seal cup and tool are to be used; a circumferential drainage groove on the outer surface adjacent the seal land; and an axial drainage groove extending from the drainage groove to the base, the circumferential drainage groove and the axial drainage groove being capable, under wellbore pressure, of conducting seepage fluid from adjacent the seal land toward the base to act against pressure invasion about the outer surface.

8. The seal cup of claim 7 wherein the elongate substantially tubular interval has a thickness increasing from the lip to the base.

9. The seal cup of claim 7 wherein the seal cup has an outer diameter along the tubular interval which tapers from the seal land towards the base.

10. The seal cup of claim 7 wherein the seal cup has an outer diameter along the tubular interval and the base, which tapers from the seal land to the base and the diameter at the base is substantially equal to the inner diameter against which the seal cup is to seal.

11. The seal cup of claim 7 including a radiused portion between the lip and the seal land.

12. The seal cup of claim 7 including a wear resistant insert in the outer surface adjacent the seal land.

* * * * *